US006491003B2

(12) United States Patent
Moteki

(10) Patent No.: US 6,491,003 B2
(45) Date of Patent: Dec. 10, 2002

(54) VARIABLE COMPRESSION RATIO MECHANISM FOR RECIPROCATING INTERNAL COMBUSTION ENGINE

(75) Inventor: Katsuya Moteki, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/961,445

(22) Filed: Sep. 25, 2001

(65) Prior Publication Data

US 2002/0043228 A1 Apr. 18, 2002

(30) Foreign Application Priority Data

Oct. 12, 2000 (JP) ..... 2000-311562

(51) Int. Cl.[7] ..... F02B 75/04
(52) U.S. Cl. ..... 123/48 B; 123/78 F
(58) Field of Search ..... 123/48 B, 78 F

(56) References Cited

U.S. PATENT DOCUMENTS 5,595,146 A * 1/1997 Bollig et al. ..... 123/48 B

OTHER PUBLICATIONS

Von Christoph Bollig et al., "Kurbeltrieb fuer variable Verdichtung", *MTZ Motortechnishe Zeitschrift* 58, No. 11, pp. 706–711, (1997).

* cited by examiner

*Primary Examiner*—Noah P. Kamen
(74) *Attorney, Agent, or Firm*—Foley & Lardner

(57) ABSTRACT

A variable compression ratio mechanism for a reciprocating internal combustion engine includes upper and lower links mechanically linking a piston pin of a piston to a crankpin, and a control link mechanically linking the lower link to an eccentric cam of a control shaft. Also provided is a control-shaft actuator capable of continuously reducing a compression ratio by driving the control shaft in a first rotational direction and of continuously increasing the compression ratio by driving the control shaft in a second rotational direction opposite to the first rotational direction, so that the compression ratio is controlled to a low value in accordance with an increase in engine speed and/or engine load. A distance from the center of the control shaft to a centerline of the control link, measured with the piston near top dead center, is dimensioned so that the distance continuously decreases as the compression ratio decreases.

10 Claims, 10 Drawing Sheets

VARIABLE COMPRESSION RATIO MECHANISM FOR RECIPROCATING INTERNAL COMBUSTION ENGINE

TECHNICAL FIELD

The present invention relates to the improvements of a variable compression ratio mechanism for a reciprocating internal combustion engine.

BACKGROUND ART

In order to vary a compression ratio between the volume existing within the engine cylinder with the piston at bottom dead center (BDC) and the volume in the cylinder with the piston at top dead center (TDC) depending upon engine operating conditions such as engine speed and load, in recent years, there have been proposed and developed multiple-link type reciprocating piston engines. One such multiple-link type variable compression ratio mechanism has been disclosed in pages 706–711 of the issue for 1997 of the paper "MTZ Motortechnische Zeitschrift 58, No. 11." The multiple-link type variable compression ratio mechanism disclosed in the paper "MTZ Motortechnische Zeitschrift 58, No. 11" is comprised of an upper link mechanically linked at one end to a piston pin, a lower link mechanically linked to both the upper link and a crankpin of an engine crankshaft, a control shaft arranged essentially parallel to the axis of the crankshaft and having an eccentric cam whose axis is eccentric to the axis of the control shaft, and a control link rockably or oscillatingly linked at one end onto the eccentric cam of the control shaft and linked at the other end to the lower end of the upper link. By way of rotary motion of the control shaft, the center of oscillating motion of the control link varies via the eccentric cam, and thus the distance between the piston pin and the crankpin also varies. In this manner, a compression ratio can be varied. In the reciprocating engine with such a multiple-link type variable compression ratio mechanism, the compression ratio is set at a relatively low value at high-load operation to avoid undesired engine knocking from occurring. Conversely, at part-load operation, the compression ratio is set at a relatively high value to enhance the combustion efficiency.

SUMMARY OF THE INVENTION

During operation of the reciprocating engine with the multiple-link type variable compression ratio mechanism, owing to a great piston combustion load (compression pressure) or inertial force a load acts upon the eccentric cam of the control shaft through the piston pin, the upper link and the control link. That is, owing to the piston combustion load, torque acts to rotate the control shaft in one rotational direction. Assuming that the magnitude of torque occurring due to piston combustion load is excessively great, a driving force needed to drive the control shaft to a desired angular position and to hold the same at the desired position has to be increased. This deteriorates an energy consumption rate of an energy source such as a motor. In other words, the energy source (i.e., the motor) has to be large-sized. Additionally, in order to withstand great torque occurring due to piston combustion load, the diameter of the control shaft has to be increased.

Depending on engine/vehicle operating conditions, switching from a part-load operating mode to a highload operating mode frequently occurs. During switching from part-load operation to high-load operation, the compression ratio is variably controlled to a low compression ratio suitable to high-load operation. Assuming that switching from high to low compression ratio is not rapid, engine knocking may occur undesirably. For the above reason, it is desirable to rapidly execute switching from high to low compression ratio.

Accordingly, it is an object of the invention to provide a variable compression ratio mechanism for a reciprocating internal combustion engine, which avoids or suppresses the maximum value of torque acting upon a control shaft owing to piston combustion load from excessively developing during operation of the engine.

It is another object of the invention to enhance the response to switch from a control-shaft angular position corresponding to a high compression ratio suitable for part-load operation to a control-shaft angular position corresponding to a low compression ratio suitable for high-load operation in a variable compression ratio mechanism for a reciprocating internal combustion engine.

In order to accomplish the aforementioned and other objects of the present invention, a variable compression ratio mechanism for a reciprocating internal combustion engine comprises a variable compression ratio mechanism for a reciprocating internal combustion engine including a piston moveable through a stroke in the engine and having a piston pin and a crankshaft changing reciprocating motion of the piston into rotating motion and having a crankpin, the variable compression ratio mechanism comprises a plurality of links mechanically linking the piston pin to the crankpin, a control shaft extending parallel to an axis of the crankshaft, an eccentric cam attached to the control shaft so that a center of the eccentric cam is eccentric to a center of the control shaft, a control link connected at a first end to one of the plurality of links and connected at a second end to the eccentric cam, an actuator that drives the control shaft within a predetermined controlled angular range and holds the control shaft at a desired angular position so that a compression ratio of the engine continuously reduces by driving the control shaft in a first rotational direction when at least one of engine speed and engine load changes from a first value to a second value higher than the first value and so that the compression ratio continuously increases by driving the control shaft in a second rotational direction opposite to the first rotational direction when the at least one of engine speed and engine load changes from the second value to the first value, and a distance from the center of the control shaft to a centerline of the control link passing through both a connecting point of the first end and a connecting point of the second end, measured with the piston near top dead center, being dimensioned so that the distance continuously decreases as the compression ratio decreases.

The other objects and features of this invention will become understood from the following description with reference to the accompanying drawings.

DESCRIPTION OF THE PREFERRED EMBODIMENTS

Figure 1:
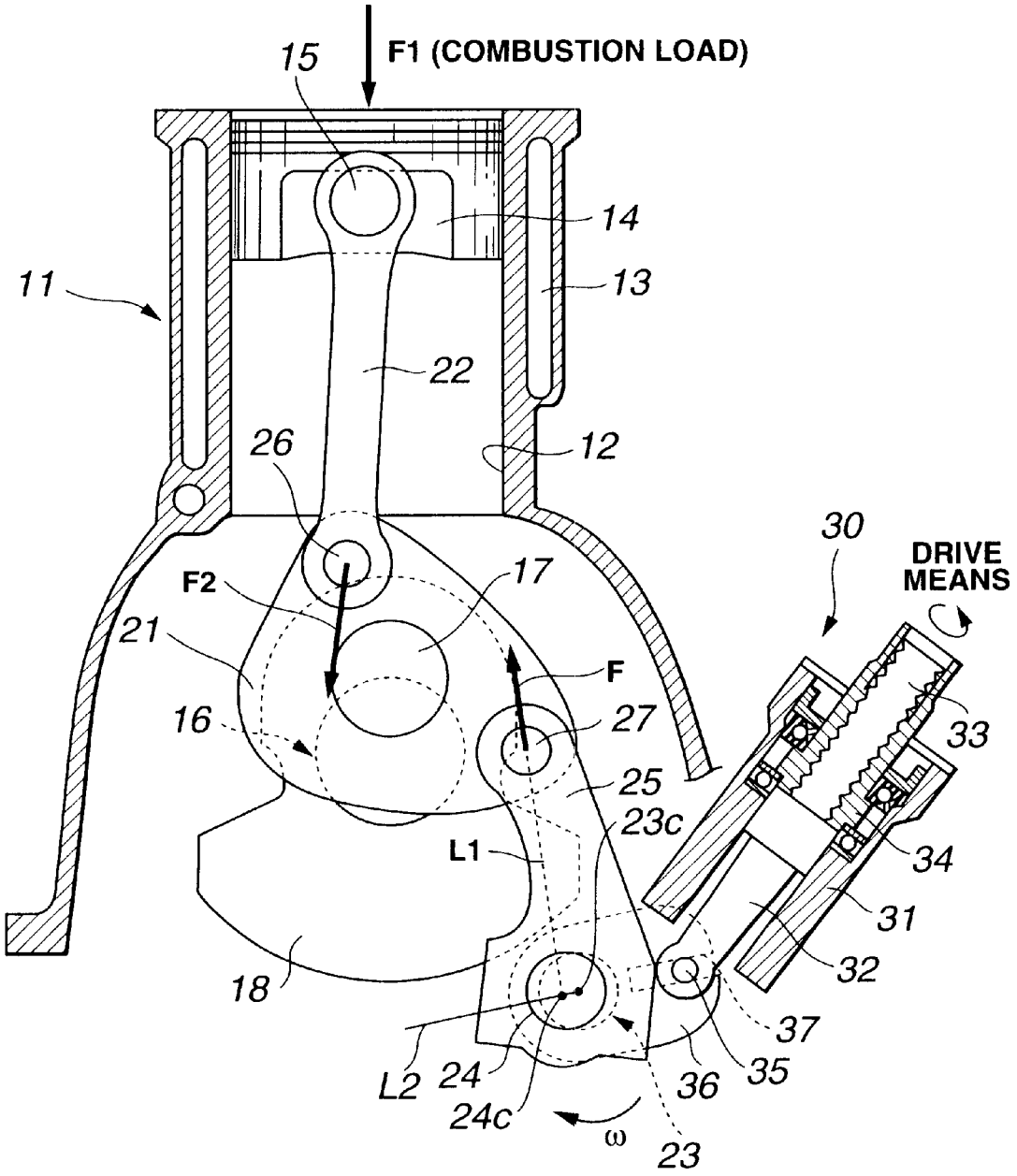
FIG. 1 is an assembled view showing a first embodiment of a multiple-link type variable compression ratio mechanism for a reciprocating engine, near TDC in a state that the compression ratio is controlled to the highest compression ratio.
Figure 2:
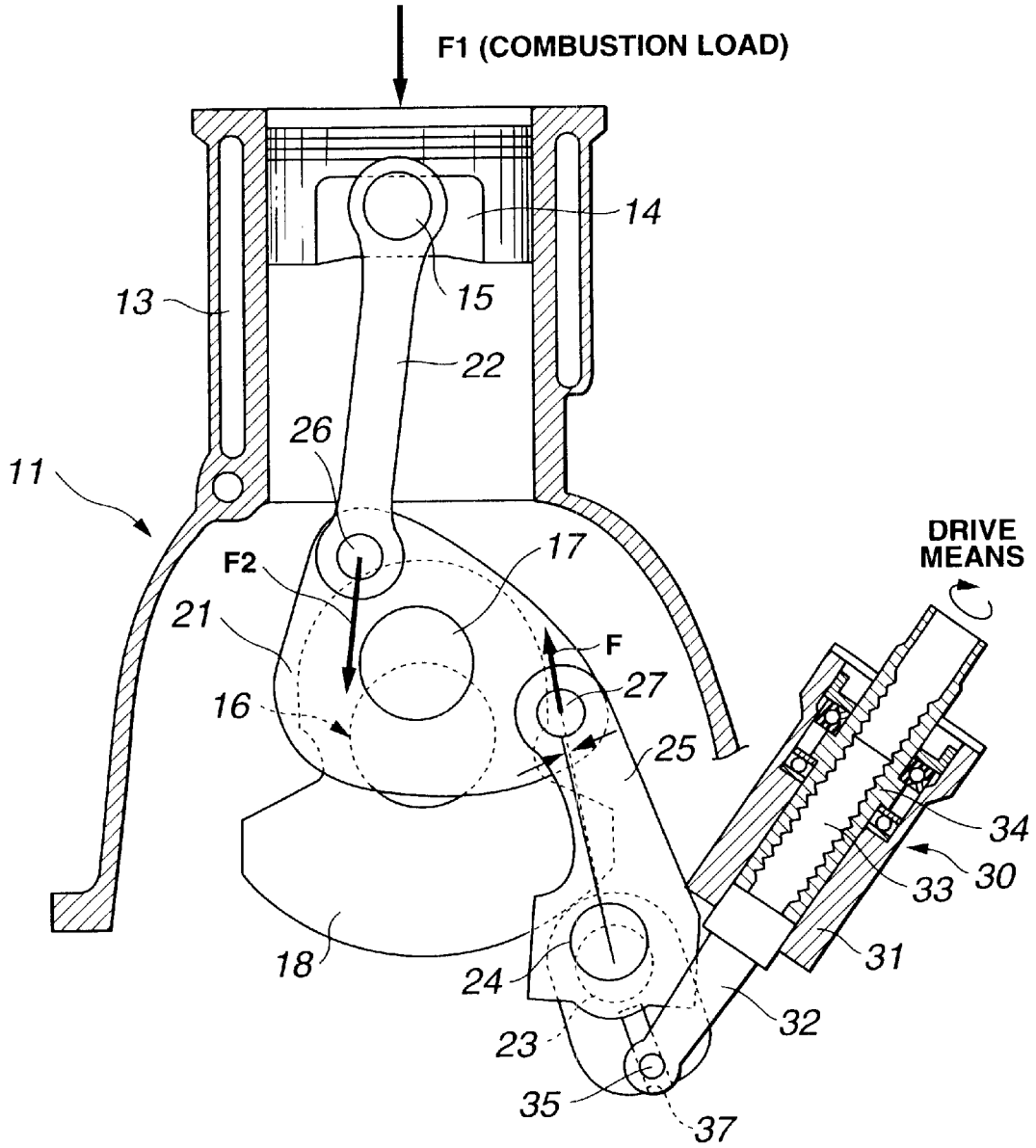
FIG. 2 is an assembled view showing the multiple-link type variable compression ratio mechanism of the first embodiment, near TDC in a state that the compression ratio is controlled to the lowest compression ratio.

Referring now to the drawings, particularly to FIG. 1, a cylinder block 11 includes engine cylinders 12, each consisting of a cylindrical design featuring a smoothly finished inner wall that forms a combustion chamber in combination with a piston 14 and a cylinder head (not shown). A water jacket 13 is formed in the cylinder block in such a manner as to surround each engine cylinder. Cylinder 12 serves as a guide for reciprocating motion of piston 14. A piston pin 15 of each of the pistons and a crankpin 17 of an engine crankshaft 16 are mechanically linked to each other by means of a multiple-link type variable compression ratio mechanism (or a multiple-link type piston crank mechanism). In FIGS. 1 and 2, reference sign 18 denotes a counterweight. The linkage of the multiple-link type variable compression ratio mechanism is comprised of three links, namely a lower link 21, a rod-shaped upper link 22, and a control link 25. Lower link 21 is fitted onto the outer periphery of crankpin 17 in a manner so as to permit relative rotation of lower link 21 to crankpin 17. Upper link 22 is provided to mechanically link the lower link therevia to the piston pin. In order to vary the attitude of each of lower link 21 and upper link 22, the variable compression ratio mechanism of the embodiment also includes a control shaft 23 extending parallel to the axis of crankshaft 16, that is, arranged in a direction parallel to the cylinder row, and an eccentric cam 24 attached to the control shaft so that the center of eccentric cam 24 is eccentric to the center of control shaft 23. Eccentric cam 24 and lower link 21 are mechanically linked to each other through control link 25. An actuator 30 (drive means) is provided to rotate or drive control shaft 23 within a predetermined controlled angular range and to hold the control shaft at a desired angular position. The upper end portion of rod-shaped upper link 22 is linked to piston pin 15 in a manner so as to permit relative rotation of upper link 22 to piston pin 15. The lower end portion of rod-shaped upper link 22 is linked or pin-connected to lower link 21 by way of a connecting pin 26, in a manner so as to permit relative rotation of upper link 22 to lower link 21. One end (the upper end) of control link 25 is linked or pin-connected to lower link 21 by way of a connecting pin 27, for relative rotation. The other end (the lower end) of control link 25 is rotatably fitted onto the outer periphery of eccentric cam 24 for relative rotation of control link 25 to eccentric cam 24. Actuator 30 includes a reciprocating block slider (or a reciprocating piston) 32 that reciprocates in an actuator casing 31 and a cylindrical member 34 having an internal screw-threaded portion engaged with an external screw-threaded portion 33 constructing the rear end portion of reciprocating block slider 32. In response to a control signal from an electronic engine control unit often abbreviated to "ECU" (not shown), cylindrical member 34 can be rotated or driven about its axis by means of a power source such as an electric motor or a hydraulic pump. The control signal value of the ECU is dependent upon engine operating conditions such as engine speed and load. Reciprocating block slider 32 is arranged in a direction normal to the axis of control shaft 23 in such a manner as to reciprocate in the actuator casing 31 in the axial direction of reciprocating block slider 32. A pin 35 is attached to the tip end portion (the front end portion) of reciprocating block slider 32 so that the axis of pin 35 is arranged in a direction perpendicular to the axial direction of reciprocating block slider 32. On the other hand, a control plate 36 is attached to one end of control shaft 23 and has a radially extending slit 37. Pin 35 of reciprocating block slider 32 is slidably fitted into slit 37 of control plate 36.

With the previously-noted arrangement, when cylindrical member 34 is driven in its one rotational direction in response to a control signal from the ECU, one axial sliding movement of reciprocating block slider 32, threadably engaged with cylindrical member 34, occurs. Conversely, when cylindrical member 34 is driven in the opposite rotational direction in response to a control signal from the ECU, the opposite axial sliding movement of reciprocating block slider 32 occurs. In this manner, the control shaft 23 can be rotated in a desired rotational direction based on the control signal from the ECU, with sliding movement of pin 35 within slit 37. As may be appreciated, actuator 30 is designed or constructed so that undesirable reciprocating motion of the reciprocating block slider is prevented by way of engagement between the internal thread of cylindrical member 34 and the external thread 33 of reciprocating block slider 32, and so that rotary motion of cylindrical member 34 is converted into reciprocating motion of reciprocating block slider 32. In this manner, the center of oscillating motion of control link 25 fitted onto eccentric cam 24 can be varied by rotating control shaft 23 depending on engine operating conditions. As a result of this, the attitude of each of upper and lower links 22 and 21 also varies. A compression ratio of the combustion chamber, that is, a compression ratio between the volume existing within the cylinder with the piston at BDC and the volume in the cylinder with the piston at TDC can be variably controlled depending upon engine operating conditions. In the shown embodiment, reciprocating block slider 32 moves forwards or downwards (viewing FIG. 1) and thus control shaft 23 rotates in a clockwise direction ω, the compression ratio can be continuously reduced. In contrast, reciprocating block slider 32 moves backwards or upwards (viewing FIG. 1) and thus control shaft 23 rotates in a counterclockwise direction opposite to the direction ω, the compression ratio can be continuously increased.

Figure 3:
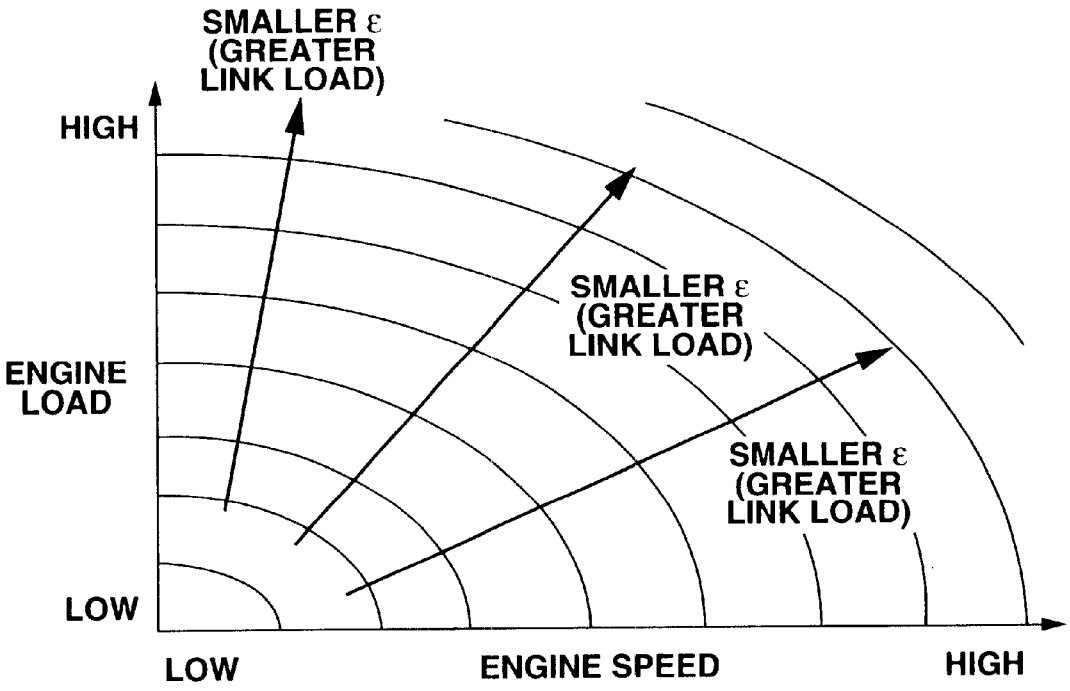
FIG. 3 is a predetermined characteristic map showing the relationship among engine speed, engine load, and a compression ratio denoted by the Greek letter $\epsilon$ (epsilon).

Referring now to FIG. 3, there is shown the predetermined or preprogrammed characteristic map showing how the compression ratio denoted by the Greek letter $\epsilon$ (epsilon) varies relative both engine speed and engine load. As can be seen from the characteristic map of FIG. 3, in a high-speed high-load range, the compression ratio is set to a relatively lower value than a low-speed low-load range. In other words, in the low-speed low-load range, the compression ratio is set to a relatively higher value than the high-speed high-load range. That is, compression ratio $\epsilon$ is controlled so that compression ratio $\epsilon$ decreases continuously as the engine speed increases and so that compression ratio $\epsilon$ decreases continuously as the engine load increases.

In the previously-discussed multiple-link type variable compression ratio mechanism of the embodiment, piston pin 15 and crankshaft 16 are linked to each other through only two links, namely upper and lower links 22 and 21. Therefore, the linkage of the variable compression ratio mechanism of the embodiment is structurally simple. Also, control link 25 is connected to the lower link instead of connecting to the upper link. Therefore, control link 25 and control shaft 23 can be laid out within a comparatively wide space defined in the lower portion of the engine. Thus, it is possible to mount the variable compression ratio mechanism of the embodiment in the engine with comparatively ease.

Figure 4:
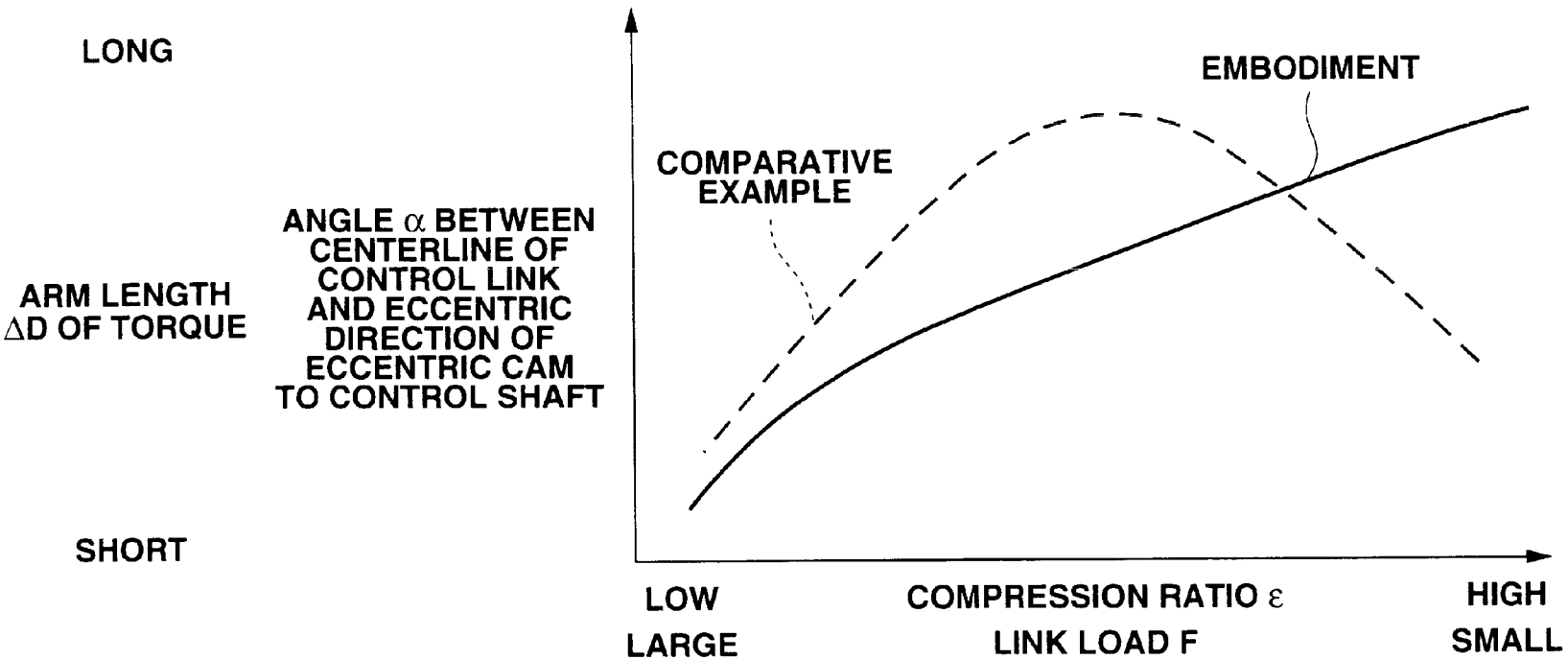
FIG. 4 shows a characteristic curve illustrating the relationship between a link load F acting upon an eccentric cam of a control shaft through a control link (or an engine compression load) and an arm length ΔD of torque (or an angle α between the centerline of the control link and the eccentric direction of the center of the eccentric cam to the axis of the control shaft), in each of the variable compression ratio mechanism of the embodiment and a variable compression ratio mechanism of a comparative example.
Figure 5:
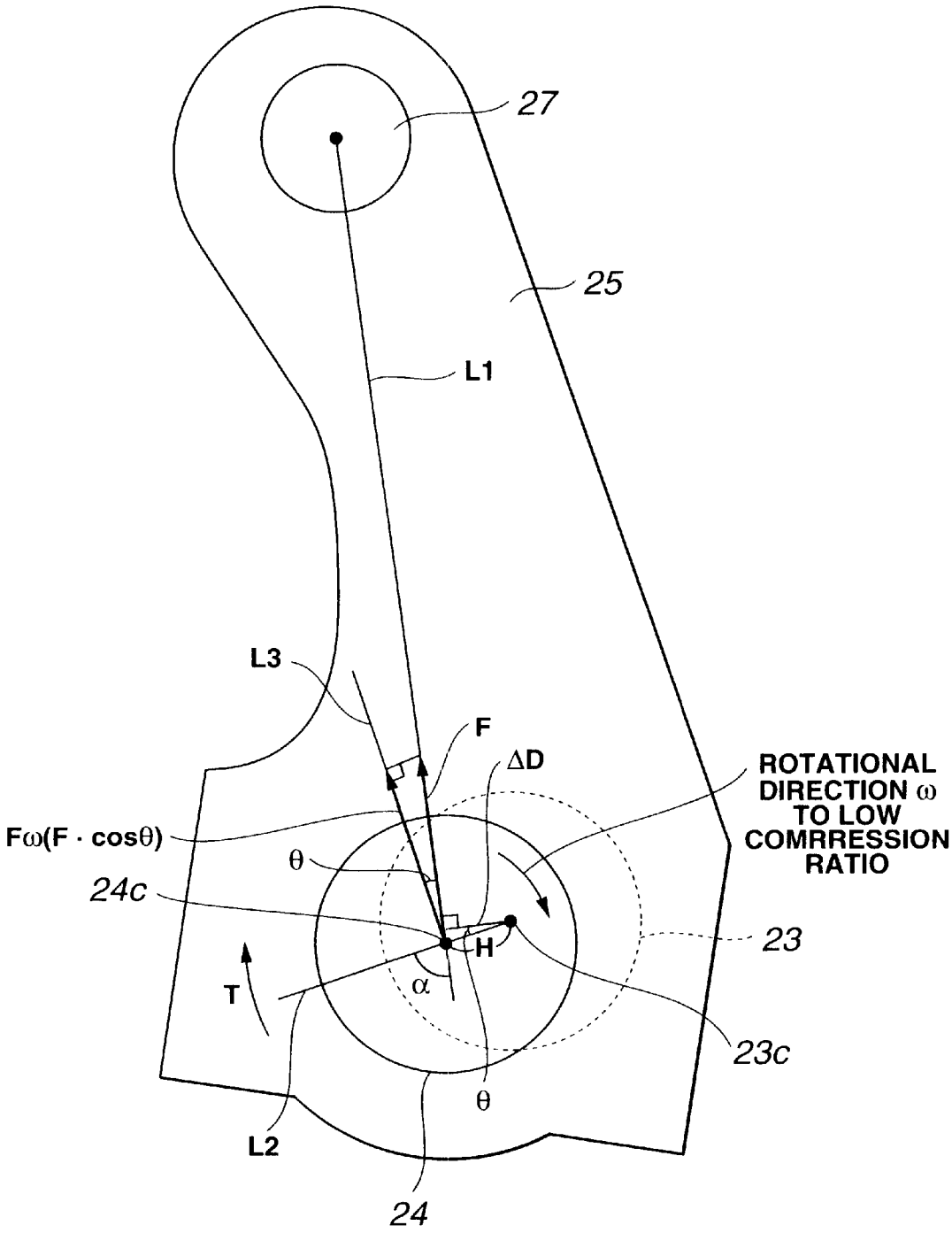
FIG. 5 is an enlarged view showing the essential part of the variable compression ratio mechanism of the first embodiment and used to explain the operation of the same.

The multiple-link type variable compression ratio mechanism of the first embodiment operates as follows. As shown in FIGS. 1 and 2, when combustion load F1 (the pressure of combustion gas) acts upon the piston crown of piston 14 and thus a load F2 is exerted through upper link 22 to lower link 21, a link load F is exerted through lower link to control link 25 so that link load F acts along a control-link centerline L1 passing through the axis of connecting pin 27 and the center of eccentric cam 24. Link load F acts upon eccentric cam 24 via control link 25, and as a result torque T acts upon control shaft 23 (see FIG. 5). Assuming that the distance between the axis of control shaft 23 (or the center 23*c* of control shaft 23) and the center 24*c* of eccentric cam 24 is an eccentric distance (simply an eccentricity) H from the axis of control shaft 23 to the center of eccentric cam 24, a line indicative of the eccentric direction of the center 24*c* of eccentric cam 24 to the center 23*c* of control shaft 23 is denoted by L2, and the angle between and the control-link centerline L1 and a line L3 perpendicular to the line L2 is denoted by $\theta$, the aforementioned torque T is derived from the equation $T=F\cdot\cos\theta\times H$. Additionally, assuming that the distance from the center 23*c* of control shaft 23 to the control-shaft centerline L1 is denoted by $\Delta D$, distance $\Delta D$ is derived from the equation $\Delta D=H\cdot\cos\theta$. That is, torque T is obtained from the equation $T=F\cdot\cos\theta\times H=F\cdot\theta D$. Distance $\Delta D$ corresponds to the arm length of torque T created by link load F. On the assumption that link load F (or combustion load F1) is the same, the longer the distance $\Delta D$, the greater the torque T. In other words, the larger the angle $\alpha(\leqq 90$ degrees) between the control-link center line L1 and the line L2 indicative of the eccentric direction of center 24*c* of eccentric cam 24 to center 23*c* of control shaft 23, the greater the torque T. Combustion load F1 (or link load F) becomes maximum with the piston near or at TDC. Therefore, as appreciated from the characteristic curve indicated by the solid line in FIG. 4, in the multiple-link type variable compression ratio mechanism of the first embodiment, distance (arm length) $\Delta D$ is dimensioned or set so that distance $\Delta D$ continuously decreases as link load F increases. That is, distance $\Delta D$ continuously decreases as compression ratio $\epsilon$ decreases. In other words, angle $\alpha$ between the two lines L1 and L2 continuously increases as compression ratio $\epsilon$ increases. By way of proper setting of the distance $\Delta D$, the distance $\Delta D$ (that is, the arm length of torque T created by link load F) tends to reduce when the maximum combustion load F1 (or the maximum link load F) created at or near TDC increases owing to an increase in engine load or engine speed. Thus, it is possible to suppress the torque-fluctuation width of torque T fluctuating due to switching between high and low compression ratios. That is to say, during operation of the engine, the magnitude of torque T can be leveled or smoothed. As a result, it is possible to down-size the actuator 30 for control shaft 23. This contributes to down-sizing of the engine itself, improved fuel economy, improved energy efficiency ratio, and down-sizing of control shaft 23. Furthermore, in the variable compression ratio mechanism of the first embodiment, as best seen in FIG. 5, a direction of one force component $F_\omega$ (equal to $F\cdot\cos\theta$ and acting in the direction of line L3) of link load F which load F acts on eccentric cam 24 via control link 25 and is created owing to the combustion load at or near TDC, is set to be the same direction as the rotational direction $\omega$ to the low compression ratio. That is, the direction of action of torque T with the piston at or near TDC is set to be the same direction as the rotational direction $\omega$ the low compression ratio. When shifting to highload operation having a possibility of knocking, in other words, when rotating control shaft 23 toward the low compression-ratio side, rotational motion of control shaft 23 toward the low compression-ratio side can be assisted by torque T. This highly enhances the response to switch from the angular position of control shaft 23 to a control-shaft angular position corresponding to the low compression ratio suitable for the high-load operation. Therefore, the occurrence of engine knocking can be certainly prevented, thus enhancing the combustion stability. In more detail, in a low-speed low-load range in which the piston combustion load Fl is relatively small, there is a tendency for the response to switching between low and high compression ratios to be lowered. In such a low-speed low-load range, the compression ratio is set to the highest compression ratio (see FIG. 1). Due to setting to the highest compression ratio, the arm length $\Delta D$ of torque T is also set at the longest distance (substantially corresponding to eccentricity H) near TDC. In other words, the angle $\alpha$ between the two lines L1 and L2 is set at the maximum angle, i.e., substantially 90 degrees near TDC (see FIG. 4), and therefore the torque value of torque T develops up to the maximum torque level. Owing to the maximum torque value, switching from high to low compression ratio can be smoothly achieved. In contrast to the above, as appreciated from the characteristic curve indicated by the broken line in FIG. 4, in the multiple-link type variable compression ratio mechanism of the comparative example, distance (arm length) $\Delta D$ is set so that distance $\Delta D$ is maximum at the medium compression ratio and relatively smaller at high and low compression ratios. The arm length $\Delta D$ obtained at the high compression ratio is shorter than that obtained at the medium compression ratio. During the early stages of switching from high to low compression ratio, the switching operation cannot be smoothly achieved, because of the relatively smaller torque T corresponding to the high compression ratio. Depending on engine/vehicle operating conditions, switching of the engine operating mode from the low-speed low-load range to the medium-speed medium-load range frequently occurs. When shifting from the low-speed low-load range to the medium-speed medium-load range, in other words, when control shaft 23 is driven or adjusted from a first angular position corresponding to a high compression ratio to a second angular position corresponding to a desired medium compression ratio, rotary motion of control shaft 23 must be stopped rapidly as soon as the control shaft approaches to the desired medium compression ratio. For this purpose, a counter driving force has to be applied to control shaft 23 by means of actuator 30 so as to exert a braking torque to the control shaft. In this case, according to the variable compression ratio mechanism of the embodiment, the arm length ΔD obtained at the medium compression ratio is set to be relatively shorter than that obtained at the high compression ratio. The torque T acting on control shaft 23 in the rotational direction ω to the low compression-ratio side can be properly reduced during shifting from high to medium compression ratio, thus effectively suppressing or reducing the previously-noted counter driving force. This improves the energy consumption rate. Moreover, In the high-speed high-load range in which the magnitude of link load F imparted through control link 25 to control shaft 23 becomes maximum, the engine compression ratio is set at the lowest compression ratio (see FIG. 3). At the lowest compression ratio, arm length ΔD of torque T becomes the shortest length. As a result of this, it is possible to effectively properly suppress a driving force that drives or rotates control shaft 23 to the high compressionratio side against torque T, and/or a holding power that holds setting of the engine compression ratio to the lowest compression ratio can be effectively suppressed or reduced. It is more preferable to set the distance (arm length) ΔD to substantially "0" near TDC and to set the angle α between L1 and L2 to substantially 0° near TDC, in a particular condition wherein the engine compression ratio is kept at the lowest compression ratio. In such a case, due to setting to the lowest compression ratio, torque T can be reduced to as small a torque value as possible, thus effectively suppressing or reducing a design driving-force value of driving force produced by actuator 30.

Figure 6:
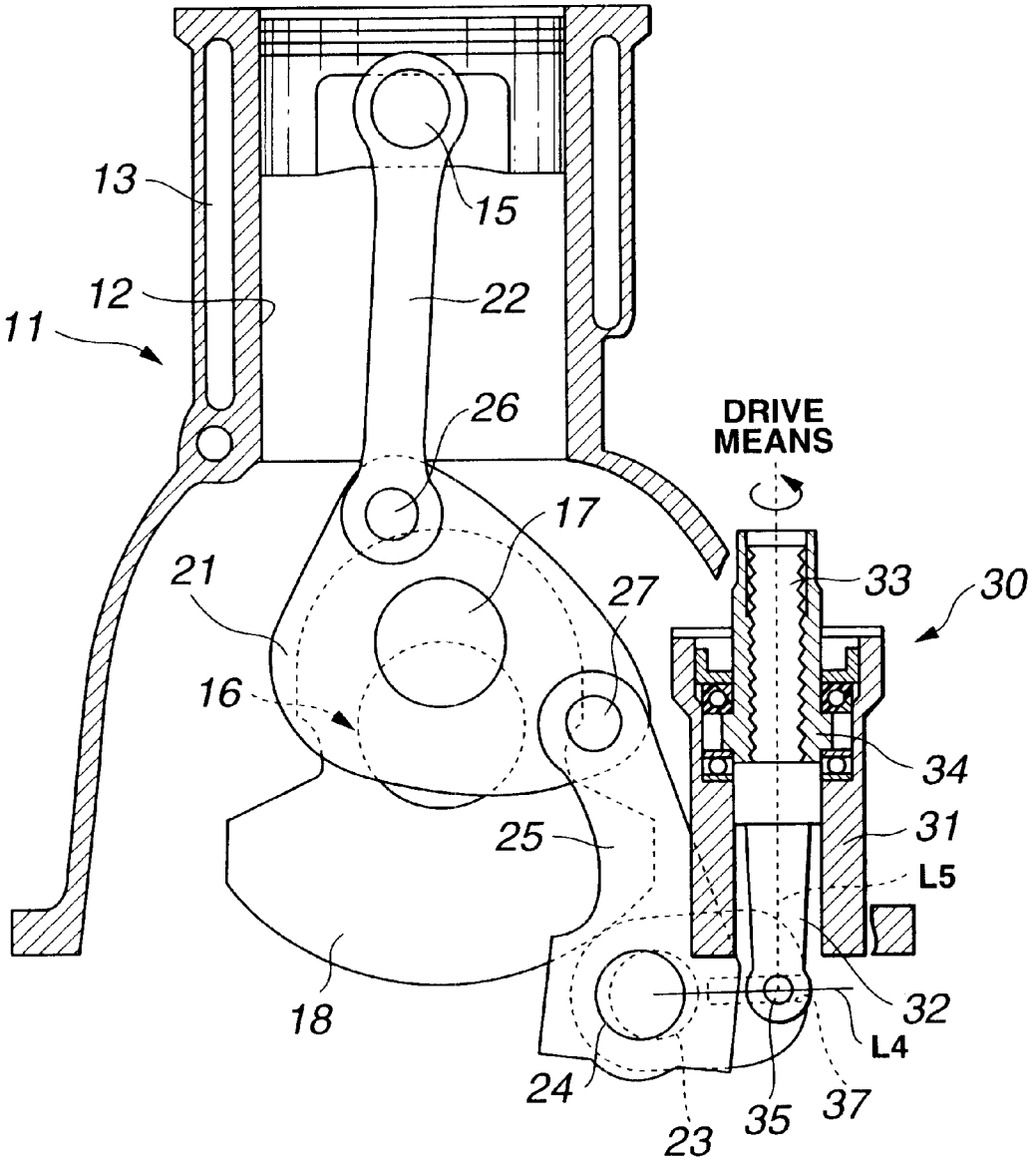
FIG. 6 is an assembled view showing a second embodiment of a multiple-link type variable compression ratio mechanism for a reciprocating engine, near TDC in a state that the compression ratio is controlled to the highest compression ratio.

Referring now to FIG. 6, there is shown the cross section of the multiple-link type variable compression ratio mechanism of the second embodiment. The variable compression ratio mechanism of the second embodiment of FIG. 6 is similar to the first embodiment of FIGS. 1 and 2, except that a line L4 indicative of a longitudinal direction of slit 37 of control plate 36 is set to be substantially perpendicular to a line L5 indicative of a direction of reciprocating motion of reciprocating block slider 32 in the mechanism of the second embodiment. Thus, the same reference signs used to designate elements in the mechanism of the first embodiment shown in FIGS. 1 and 2 will be applied to the corresponding reference signs used in the mechanism of the second embodiment shown in FIG. 6, for the purpose of comparison of the first and second embodiments. Detailed description of the same elements will be omitted because the above description thereon seems to be self-explanatory. In case of the perpendicular layout between line L4 indicative of the longitudinal direction of slit 37 of control plate 36 and line L5 indicative of the direction of reciprocating motion of reciprocating block slider 32, a direction of action of a load exerted from control shaft 23 to reciprocating block slider 32 near TDC owing to the piston combustion load is set to be the same direction as the direction of reciprocating motion of reciprocating block slider 32, with the compression ratio set at the highest compression ratio at which the possibility of knocking is high and thus a higher response to switching from high to low compression ratio is required. As a consequence, an instantaneous speed reduction ratio or an instantaneous deceleration rate of a power-transmission mechanism that transmits from a power source such as an electric motor or a hydraulic pump to control shaft 23 can be effectively reduced. Owing to the reduced instantaneous reduction ratio arising from the previously-noted perpendicular layout, the switching operation from high to low compression ratio can be effectively assisted by virtue of piston combustion load F1. Thus, it is possible to remarkably enhance the response to switching of reciprocating block slider 32 to the low compression-ratio side.

Figure 7A:
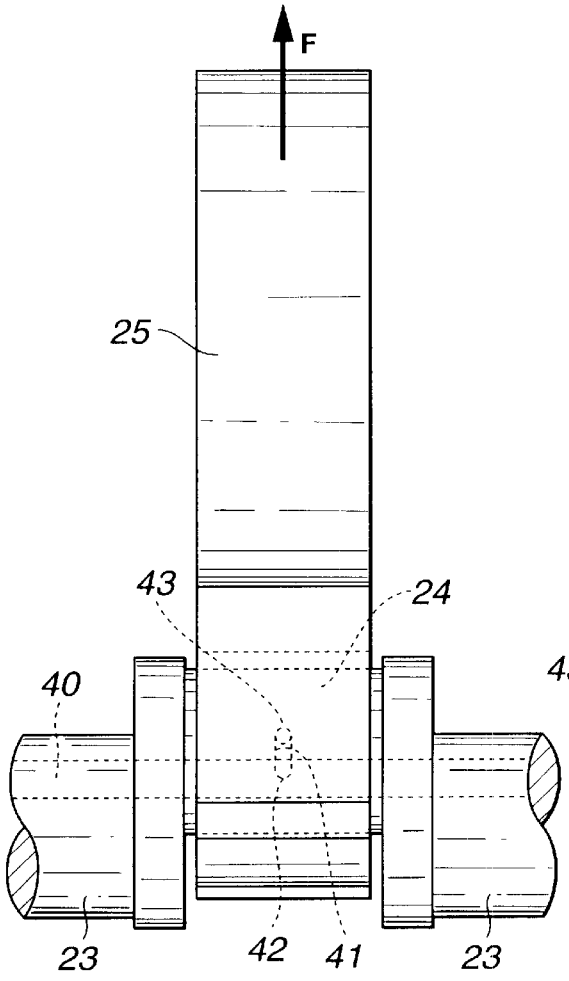
FIGS. 7A and 7B respectively show a side view and a cross section of the essential part of a variable compression ratio mechanism of a third embodiment.
Figure 10A:
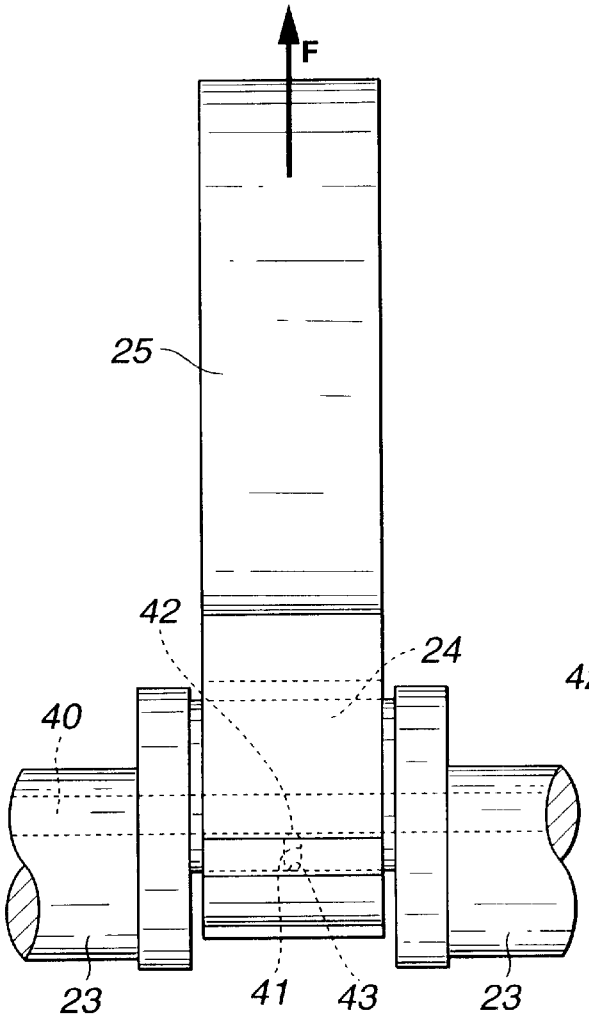
FIGS. 10A and 10B respectively show a side view and a cross section of the essential part of the variable compression ratio mechanism of the second comparative example.
Figure 10B:
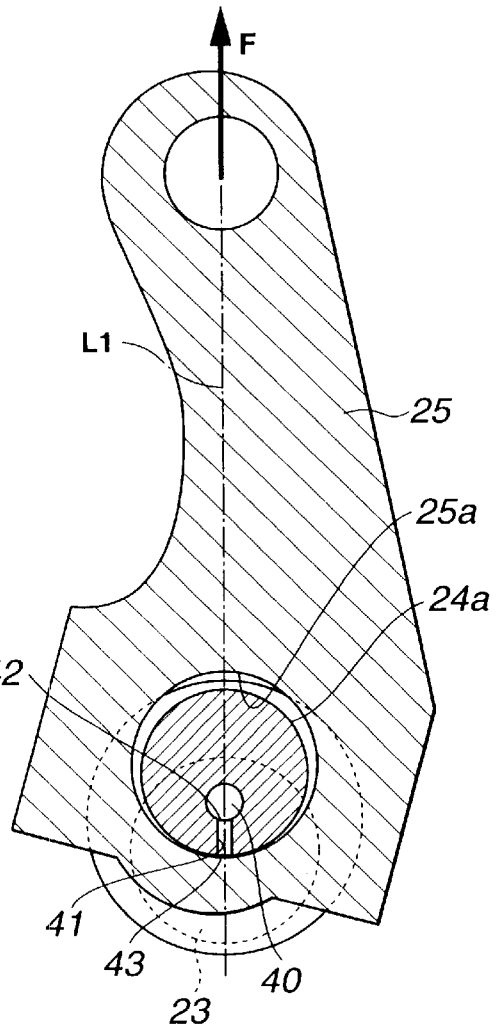

Good and poor lubricating-oil passage layouts are explained hereunder in reference to FIGS. 7A through 10B. FIGS. 7A and 7B show the good lubricating-oil passage layout used in the variable compression ratio mechanism of the third embodiment. FIGS. 8A and 8B show the good lubricating-oil passage layout used in the variable compression ratio mechanism of the fourth embodiment. On the other hand, FIGS. 9A and 9B show the poor lubricating-oil passage layout used in the variable compression ratio mechanism of the first comparative example. FIGS. 10A and 10B show the poor lubricating-oil passage layout used in the variable compression ratio mechanism of the second comparative example.

As shown in FIGS. 7A–10B, the control shaft 23 (including eccentric cam 24) is formed therein with first and second lubricating-oil passage portions 40 and 41, in order to feed lubrication oil to the shaft journal portion of control shaft 23. First lubricating-oil passage portion 40 is axially formed in the control shaft in a manner so as to pass the interior of control shaft 23 and the interior of eccentric cam 24 and to axially extend parallel to the axis of control shaft 23. On the other hand, second lubricating-oil passage portion 41 is a straight oil passage formed in the eccentric cam in a manner so as to pass the interior of eccentric cam 24 and to extend in a direction perpendicular to the axially-extending first lubricating-oil passage portion 40. An inlet port 42 of second oil-lubricating passage portion 41 is opened to first oil-lubricating passage portion 40. On the other hand, an outlet port 43 of second oil-lubricating passage portion 41 is opened into a clearance space defined between the bearing surface 25*a* of control link 25 and the outer peripheral surface 24*a* of eccentric cam 24. Outer peripheral surface 24*a* is opposite to and in sliding-contact with bearing surface 25*a*. As shown in FIGS. 9A, 9B, 10A and 10B, if outlet port 43 of second oil-lubricating passage portion 41 is laid out in the vicinity of control-link centerline L1 near TDC in a state where the compression ratio is set at the lowest compression ratio, there are some drawbacks. For example, as shown in FIGS. 9A and 9B, when outlet port 43 is laid out along control-link centerline L1 in a side (the upper side) opposite to the axis of control shaft 23, lubricating oil is fed into the widest space (the maximum bearing clearance space) defined between the two opposing surfaces 25*a* and 24*a*. Most of lubricating oil fed into the clearance is wastefully flown out in the cross direction of the shaft journal portion of eccentric cam 24. In contrast, as shown in FIGS. 10A and 10B, when outlet port 43 is laid out along control-link centerline L1 in the other side (the lower side) facing the axis of control shaft 23, outlet port 43 is located in the high-bearing-pressure area of maximum loading. In such a case, the effective pressure-receiving area of the shaft bearing portion may be reduced undesirably. As set out above, in the case that outlet port 43 is laid out to be in alignment with control-link centerline L1 and its vicinity with the piston near TDC in a state where the compression ratio is set to the lowest compression ratio, sufficient lubricating effect cannot be provided.

Figure 7B:
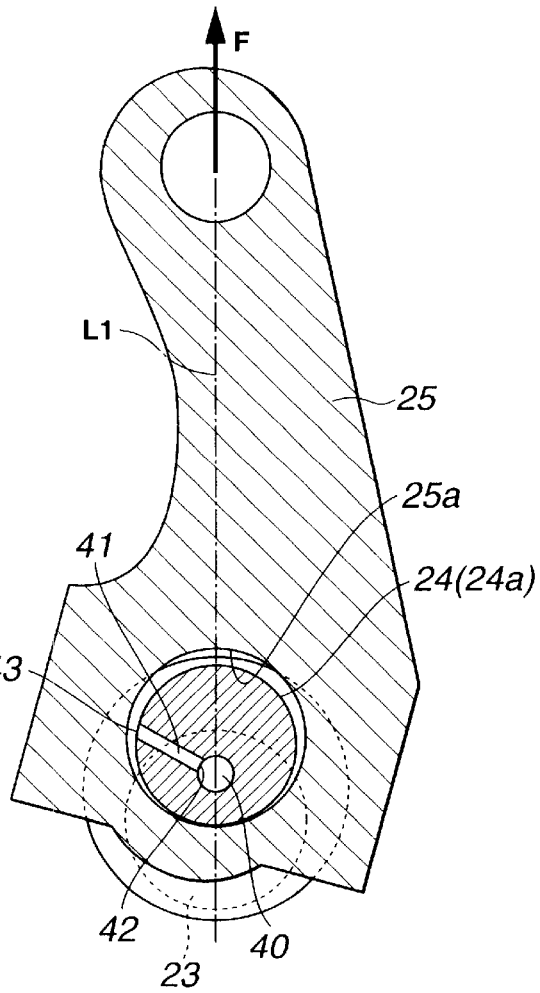
Figure 8A:
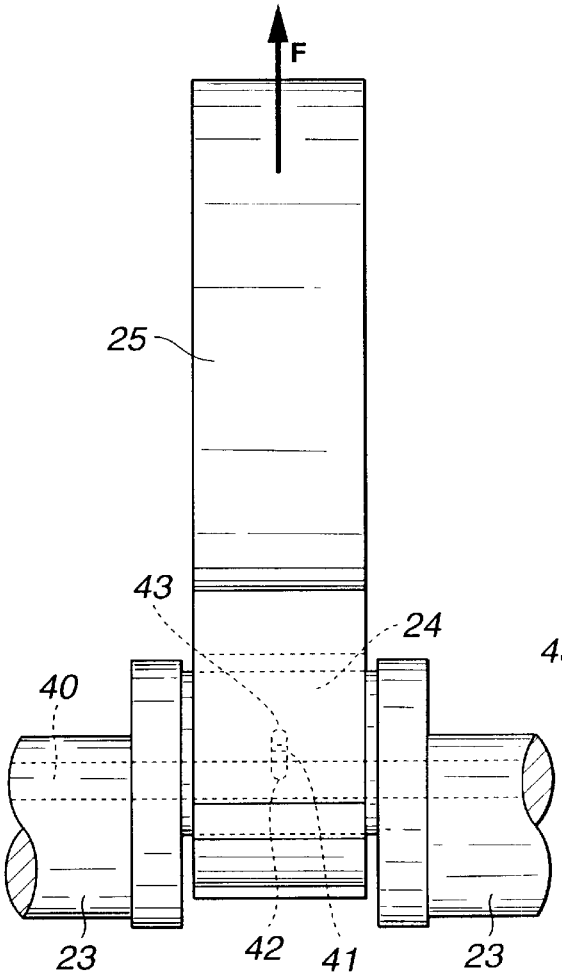
FIGS. 8A and 8B respectively show a side view and a cross section of the essential part of a variable compression ratio mechanism of a fourth embodiment.
Figure 8B:
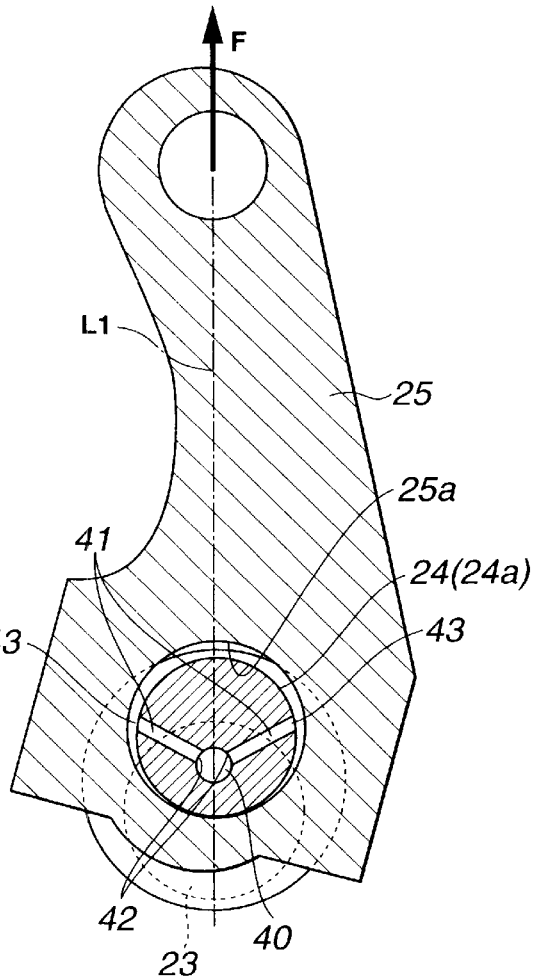
Figure 9A:
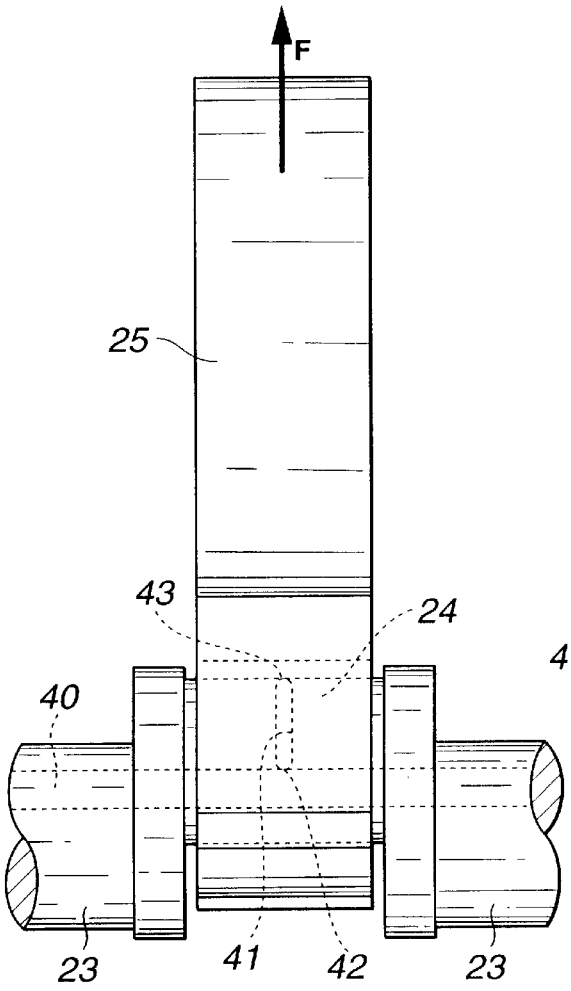
FIGS. 9A and 9B respectively show a side view and a cross section of the essential part of the variable compression ratio mechanism of the first comparative example.
Figure 9B:
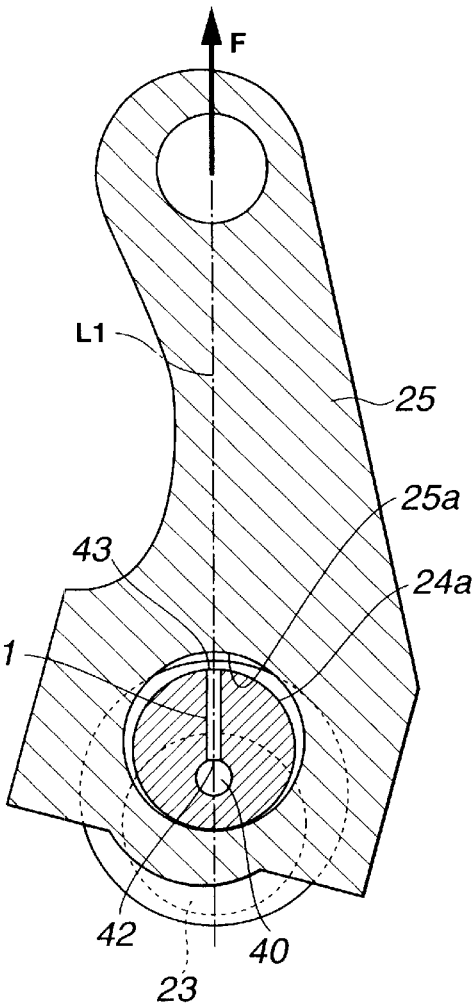

From the viewpoint as discussed above, in the variable compression ratio mechanism of each of the third (FIGS. 7A and 7B) and fourth (FIGS. 8A and 8B) embodiments, as viewed from the lateral cross section shown in FIG. 7B or 8B, outlet port 43 of second oil-lubricating passage portion 41 is laid out in such a manner as to be spaced apart from each of two intersection points of the circumference of eccentric cam 24 and control-link centerline L1 or apart from the vicinity of each of the two intersection points. Concretely, outlet port 43 is laid out at or nearby a position of outer peripheral surface 24*a* of eccentric cam 24 that crosses a line passing through eccentric-cam center 24*c* and arranged perpendicular to control-link centerline L1, so that the distance from outlet port 43 to control-link centerline L1 is substantially maximum. In the third embodiment shown in FIGS. 7A and 7B, only one second lubricating-oil passage portion 41 is formed in each of eccentric cams 24 and therefore outlet port 43 is arranged on one side of control-link centerline L1. In the fourth embodiment shown in FIGS. 8A and 8B, two second lubricating-oil passage portions (41, 41) are formed in each of eccentric cams 24 and therefore two outlet ports (43, 43) are respectively arranged on both sides of control-link centerline L1 so that these outlet ports (43, 43) are diametrically opposed to each other with respect to the center (or axis) of eccentric cam 24. Owing to the good lubricating-oil passage layout, in particular owing to the good layout of outlet port 43 of second lubricating-oil passage portion 41, it is possible to provide sufficient lubrication of the shaft journal portion of eccentric cam 24 and sufficient lubrication of the bearing portion of control link 25 by way of lubricating oil supplied or discharged into the middle-pressure area through outlet port 43 of second lubricating-oil passage portion 41, without lowering the pressure-receiving surface.

The entire contents of Japanese Patent Application No. P2000-311562 (filed Oct. 12, 2000) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable compression ratio mechanism for a reciprocating internal combustion engine including a piston moveable through a stroke in the engine and having a piston pin and a crankshaft changing reciprocating motion of the piston into rotating motion and having a crankpin, the variable compression ratio mechanism comprising:

a plurality of links mechanically linking the piston pin to the crankpin;

a control shaft extending parallel to an axis of the crankshaft;

an eccentric cam attached to the control shaft so that a center of the eccentric cam is eccentric to a center of the control shaft;

a control link connected at a first end to one of the plurality of links and connected at a second end to the eccentric cam;

an actuator that drives the control shaft within a predetermined controlled angular range and holds the control shaft at a desired angular position so that a compression ratio of the engine continuously reduces by driving the control shaft in a first rotational direction when at least one of engine speed and engine load changes from a first value to a second value higher than the first value and so that the compression ratio continuously increases by driving the control shaft in a second rotational direction opposite to the first rotational direction when the at least one of engine speed and engine load changes from the second value to the first value; and a distance from the center of the control shaft to a centerline of the control link passing through both connecting points of the first and second ends, measured with the piston near top dead center, being dimensioned so that the distance continuously decreases as the compression ratio decreases.

2. The variable compression ratio mechanism as claimed in claim 1, wherein a direction of one force component of a load acting on the eccentric cam via the control link owing to combustion load acting on the piston near the top dead center, is set to be identical to the first rotational direction, the one force component acting in a direction of a line perpendicular to a line indicative of an eccentric direction of the center of the eccentric cam to the center of the control shaft.

3. The variable compression ratio mechanism as claimed in claim 2, wherein an angle between the centerline of the control link and the line indicative of the eccentric direction is set to be substantially 90 degrees with the piston near the top dead center in a state where the compression ratio is set at a highest compression ratio.

4. The variable compression ratio mechanism as claimed in claim 2, wherein the distance from the center of the control shaft to the centerline of the control link is set to be substantially 0 with the piston near the top dead center in a state where the compression ratio is set at a lowest compression ratio.

5. The variable compression ratio mechanism as claimed in claim 1, wherein the plurality of links comprises an upper link connected at one end to the piston pin and a lower link connected to both the crankpin and the other end of the upper link, and one end of the control shaft is connected to the lower link through the control link.

6. The variable compression ratio mechanism as claimed in claim 1, wherein the actuator comprises a reciprocating block slider capable of reciprocating in a direction normal to an axis of the control shaft, and the reciprocating block slider has a pin attached to a tip end portion of the reciprocating block slider and the control shaft has a radially-extending slit formed at its shaft end, and a line indicative of a longitudinal direction of the slit is set to be substantially perpendicular to a line indicative of a direction of reciprocating motion of the reciprocating block slider in a state where the compression ratio is set at a highest compression ratio.

7. The variable compression ratio mechanism as claimed in claim 1, wherein the control shaft and the eccentric cam have a lubricating-oil passage formed therein, and an outlet port of the lubricating-oil passage is opened into a clearance space defined between a bearing surface of the control link and an outer peripheral surface of the eccentric cam being in sliding-contact with the bearing surface of the control link, and the outlet port is laid out to be out of alignment with the centerline of the control link and its vicinity with the piston near the top dead center in a state where the compression ratio is set at a lowest compression ratio.

8. The variable compression ratio mechanism as claimed in claim 7, wherein the lubricating-oil passage comprises a first lubricating-oil passage portion formed in the control shaft and extending parallel to the axis of the control shaft and a second lubricating-oil passage portion formed in the eccentric cam and extending in a direction perpendicular to the first lubricating-oil passage portion, and an inlet port of the second lubricating-oil passage portion is opened to the first lubricating-oil passage portion while an outlet port of the second lubricating-oil passage portion is opened into the clearance space defined between the bearing surface of the control link and the outer peripheral surface of the eccentric cam.

9. The variable compression ratio mechanism as claimed in claim 8, wherein the outlet port is laid out at or nearby a position of the outer peripheral surface of the eccentric cam that crosses a line passing through the center of the eccentric cam and arranged perpendicular to the centerline of the control link so that a distance from the outlet port to the centerline of the control link is substantially maximum, with the piston near the top dead center in the state where the compression ratio is set at the lowest compression ratio.

10. The variable compression ratio mechanism as claimed in claim 9, wherein two second lubricating-oil passage portions are formed in the eccentric cam and two outlet ports are respectively arranged on both sides of the centerline of the control link so that the two outlet ports are diametrically opposed to each other with respect to the center of the eccentric cam.

* * * * *